US009470082B1

(12) United States Patent
Williams et al.

(10) Patent No.: US 9,470,082 B1
(45) Date of Patent: Oct. 18, 2016

(54) BLOWOUT-PREVENTER-STACK ONE-TRIP TEST TOOL AND METHOD

(71) Applicants: Brian Williams, Purvis, MS (US); Gregory LaFleur, Sulphur, LA (US)

(72) Inventors: Brian Williams, Purvis, MS (US); Gregory LaFleur, Sulphur, LA (US)

(73) Assignee: BACKOFF, LLC, Sulphur, LA (US)

( * ) Notice: Subject to any disclaimer, the term of this patent is extended or adjusted under 35 U.S.C. 154(b) by 0 days.

(21) Appl. No.: 14/704,646

(22) Filed: May 5, 2015

(51) Int. Cl.
*E21B 47/00* (2012.01)
*E21B 33/064* (2006.01)

(52) U.S. Cl.
CPC ..... *E21B 47/00* (2013.01); *E21B 33/064* (2013.01)

(58) Field of Classification Search
CPC .... E21B 33/064; E21B 34/045; E21B 47/00; E21B 47/0001
See application file for complete search history.

(56) References Cited

U.S. PATENT DOCUMENTS 2,982,125 A * 5/1961 Gilreath ..... E21B 47/1025 166/381
3,675,719 A 7/1972 Slator et al.
3,958,049 A 5/1976 Payne
4,018,276 A * 4/1977 Bode ..... E21B 33/06 166/183
4,030,354 A * 6/1977 Scott ..... E21B 47/1025 73/152.01
4,121,660 A * 10/1978 Koleilat ..... E21B 23/02 166/123
4,212,355 A 7/1980 Reardon
4,373,380 A 2/1983 Mayo
4,554,976 A 11/1985 Hynes
4,559,809 A 12/1985 Mayo
4,564,068 A * 1/1986 Baugh ..... E21B 33/043 166/123
4,648,445 A 3/1987 Caskey
4,862,960 A 9/1989 Garbett
4,881,598 A 11/1989 Stockinger et al.
5,730,218 A 3/1998 Swagerty et al.
5,890,541 A 4/1999 Jennings et al.
6,032,736 A 3/2000 Williams
6,044,690 A * 4/2000 Williams ..... E21B 33/064 166/250.08
6,152,225 A 11/2000 Young et al.
6,186,237 B1 * 2/2001 Voss, Jr. ..... E21B 21/106 166/337
6,296,225 B1 10/2001 Watts
6,390,194 B1 5/2002 Young et al.
7,062,960 B2 6/2006 Couren et al.
7,207,384 B2 * 4/2007 Dallas ..... E21B 47/1025 166/250.08
7,334,634 B1 2/2008 Abel
2004/0231856 A1 11/2004 Dallas et al.
2008/0185143 A1 * 8/2008 Winters ..... E21B 47/06 166/250.07
2009/0095464 A1 * 4/2009 McGrath ..... E21B 33/06 166/53
2013/0111985 A1 * 5/2013 Veeningen ..... E21B 47/06 73/152.51
2013/0167944 A1 * 7/2013 Egeland ..... E21B 33/064 137/15.18
2014/0060848 A1 3/2014 McMiles
2014/0123747 A1 * 5/2014 Veeningen ..... E21B 47/0001 73/152.51
2015/0034338 A1 * 2/2015 Lim ..... E21B 33/035 166/386

* cited by examiner

*Primary Examiner* — Matthew R Buck
*Assistant Examiner* — Aaron Lembo
(74) *Attorney, Agent, or Firm* — Keaty Law Firm LLC

(57) ABSTRACT

A blowout-preventer-stack one-trip test tool and method providing a solid test pin for sealing the test plug in the wellhead, a running tool for securely placing, separating from, reattaching, and removing the solid test pin, testing all fixed and variable rams and annulars and testing all blind and shear rams without damage to pipe, in one trip, and a fail-safe secondary provision for removing the solid test plug on a second trip with an emergency retrieval tool if necessary.

12 Claims, 3 Drawing Sheets

BLOWOUT-PREVENTER-STACK ONE-TRIP TEST TOOL AND METHOD

BACKGROUND OF THE INVENTION

This invention provides a blowout-preventer-stack one-trip test tool and method for the oil-and-gas drilling industry.

Drilling for petroleum, especially under water and in deep water, is a very expensive operation, with costs accruing every day whether actual drilling is occurring or not. The cost of suspending drilling operations for required safety testing is immense.

The blowout preventer (BOP) or more precisely the blowout preventer stack of several different types of BOPs is a standard and required piece of safety equipment for oil-and-gas drilling. It is located at the wellhead, which, for deep-water drilling, is at the bottom of the sea. It protects against blowouts caused by kicks or bumps of sub-surface pressure rising from the well.

The drill string is composed primarily of sections of drill pipe surrounded by a casing. The drill pipe moves into and out of the well as drilling progresses. The casing stays in place after it is initially set. Both the drill pipe and the casing are subject to separately varying levels of sub-surface pressure. Drilling fluid or drilling mud is injected into the drill pipe and separately into the casing at closely monitored pressures to counteract the sub-surface pressure. Blowout preventers serve the purpose of sealing off either the casing or the casing and the drill string of the entire well to prevent sub-surface pressure from overwhelming the counteracting pressure of the drilling mud.

Of the various types of blowout preventers in a stack, annulars and fixed and variable rams are designed to seal the casing around the drill pipe while leaving an area to accommodate and not damage the drill pipe. The casing is more susceptible to loss of control of pressure kicks than the drill pipe is, and damage to the drill pipe can cause delays or even complete loss of a well. Blind and shear rams, however, are designed to completely seal off the entire casing, and will damage or shear any drill pipe inside the casing.

Blowout preventer stacks are a regulated and required element of drilling. The regulations require that blowout preventer stacks must be tested frequently and thoroughly. Testing requires that drilling operations be suspended, that the drill string be pulled out of the hole, that a test plug be set at the wellhead, that testing of the rams and annulars be performed, that the test plug be removed, and that the drill string be run back into the hole in order to resume drilling.

Drill pipe is made in typically 30-foot sections, and a drill string has to be assembled at the drilling rig from those sections of drill pipe as the drilling progresses. When the drill string is pulled out of the hole, the sections of the drill pipe have to be disassembled and stacked, and then reassembled on the next trip into the hole. Deep-water drilling requires vast lengths of drill pipe just to reach the wellhead, and then more vast lengths of drill pipe to drill into the seabed. Pulling the drill string out of the hole, running the test plug into and out of the hole, and putting the drill string back into the hole, in deep water, is an operation that can take several days and several cycles of disassembly and reassembly of thousands of sections of drill pipe.

Thorough testing of a blowout preventer stack presently requires more than one trip into the hole, which further delays resumption of drilling operations, because testing of rams fixed for different diameters of pipe require the insertion and removal of those different diameters of pipe, and testing of the blind and shear rams must be performed with no pipe present in the blowout preventer at the wellhead.

For some phases of BOP testing, the wellhead immediately below the BOP stack must be tightly sealed off from the well below, by the test plug, in order to prevent leakage of any pressure coming form or going into the sub-surface well and making it impossible to determine if the blowout preventers are properly holding pressure between each BOP and the test plug at the wellhead. Presently this sealing and unsealing of the test plug at the wellhead requires more than one trip into the hole and carries a risk of not being able to unseal the wellhead and resume drilling operations.

The frequent and thorough testing of blowout preventer stacks is an important safety precaution that is required to be done, but at present, especially for deep-water drilling, the testing of blowout preventer stacks requires long, costly suspensions of drilling operations.

SUMMARY OF THE INVENTION

The present invention provides a blowout-preventer-stack one-trip test tool and method providing a solid test pin for sealing the test plug in the wellhead, a running tool for securely placing, separating from, reattaching, and removing the solid test pin, testing all fixed and variable rams and annulars and testing all blind and shear rams without damage to pipe, in one trip, and a fail-safe secondary provision for removing the solid test plug on a second trip with an emergency retrieval tool if necessary.

The present invention allows thorough testing of blowout preventer stacks in significantly less downtime of suspended drilling, by providing performance of all tests of all blowout preventer components in one trip into and out of the hole, by securely sealing the standard test plug at the wellhead to prevent leakage, and by providing an improved primary method of disconnection and re-connection at the wellhead for retrieval, and also a backup secondary method for retrieval using an emergency retrieval tool.

BRIEF DESCRIPTION OF DRAWINGS

Reference will now be made to the drawings, wherein like parts are designated by like numerals, and wherein.

DETAILED DESCRIPTION OF THE INVENTION

Figure 1:
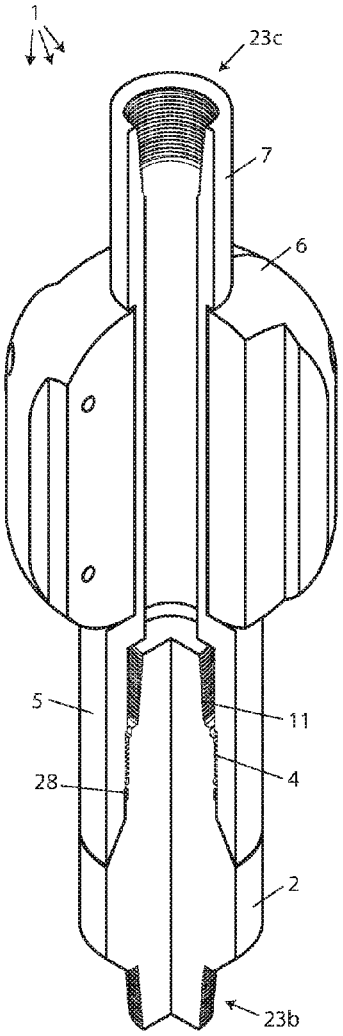
FIG. 1 is a partially cutaway perspective view of the invention assembled.
Figure 2:
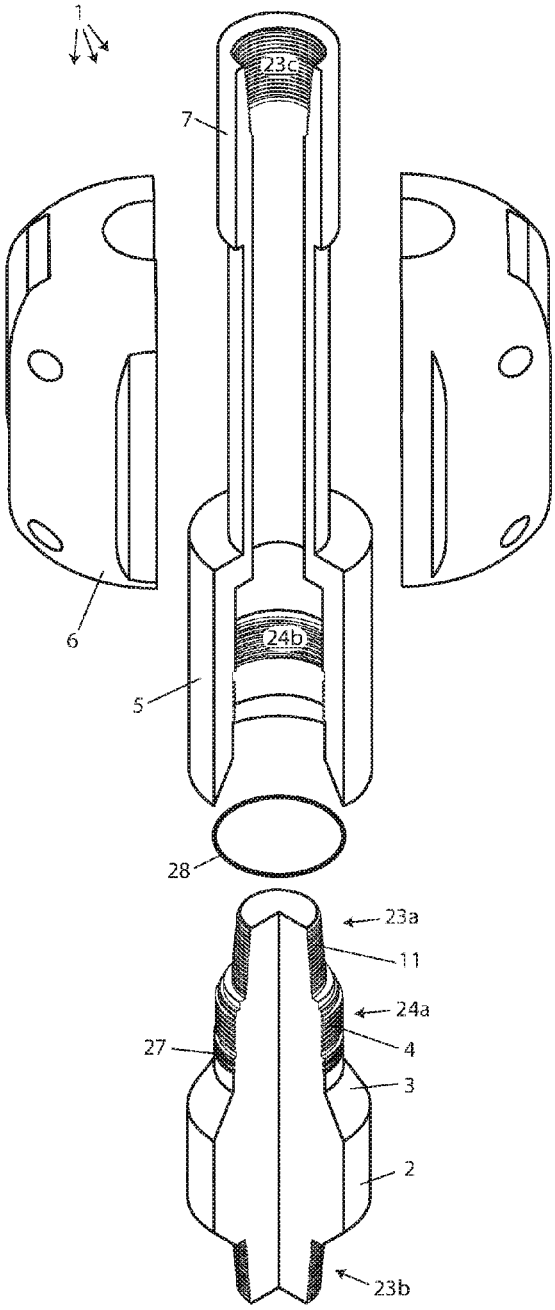
FIG. 2 is a partially cutaway exploded view of the invention.

Referring to FIG. 1 and FIG. 2, our blowout-preventer-stack one-trip test tool 1 provides a solid test pin 2 having a bottom portion threaded with standard drill-pipe threads 23 that include a first plug 23*a*, a second plug 23*b*, and a socket 23*c* for the purpose of connecting to a standard test plug. Standard drill-pipe threading is intended to be used at relatively high torque, with no additional seal, to form a sufficient pressure-holding connection. The solid test pin further has a large entry bevel 3, a primary connector surface 4 having threads 24 that include a plug 24*a* and a socket 24*b* different from standard drill-pipe threads, and a secondary connector surface 11 having standard drill-pipe threads 23 with first plug 23*a*.

The threading 24 with plug 24*a* on the primary connector surface 4 is adapted to form a sufficient pressure-holding connection at a relatively low right-hand torque, and may be used in conjunction with a pin seal 28 mounted in a pin-seal groove 27 on the primary connector surface to increase the effectiveness of the relatively low-torque connection. The primary connector surface 4, and the large entry bevel 3 are adapted to be easily disconnected from and reconnected with the running tool 5 while the assembly is at the wellhead, at the remote end of a long length of drill string.

The secondary connector surface 11 having standard drill-pipe threads 23 with first plug 23*a* is adapted to provide a backup means of retrieval in case re-connection of the running tool 5 to the primary surface connector 4 is not successfully performed. This backup means of retrieval can be performed using an emergency retrieval tool 12 instead of the running tool.

The running tool 5 has a bottom portion adapted to easily disconnect and re-connect with the test pin 2, while the assembly is at the wellhead, having a large entry bevel matching that of the solid test pin, which promotes correct placement, and having threading 24 with plug 24*a* and socket 24*b* matching that of the primary connector surface 4 of the solid test pin, adapted to form a sufficient pressure-holding connection at a relatively low torque.

A centralizer 6 is mounted surrounding a portion of the running tool 5, and serves to keep the tool in the center of the BOP stack during the time that it is disconnected, so that it can be more easily re-connected to the solid test pin.

A drill-pipe connector 7 at the top of the running tool 5 has standard drill-pipe threading 23 with socket 23*c* so that the test assembly can be run into the hold using standard drill pipe, with or without a special-purpose test joint.

Figure 3:
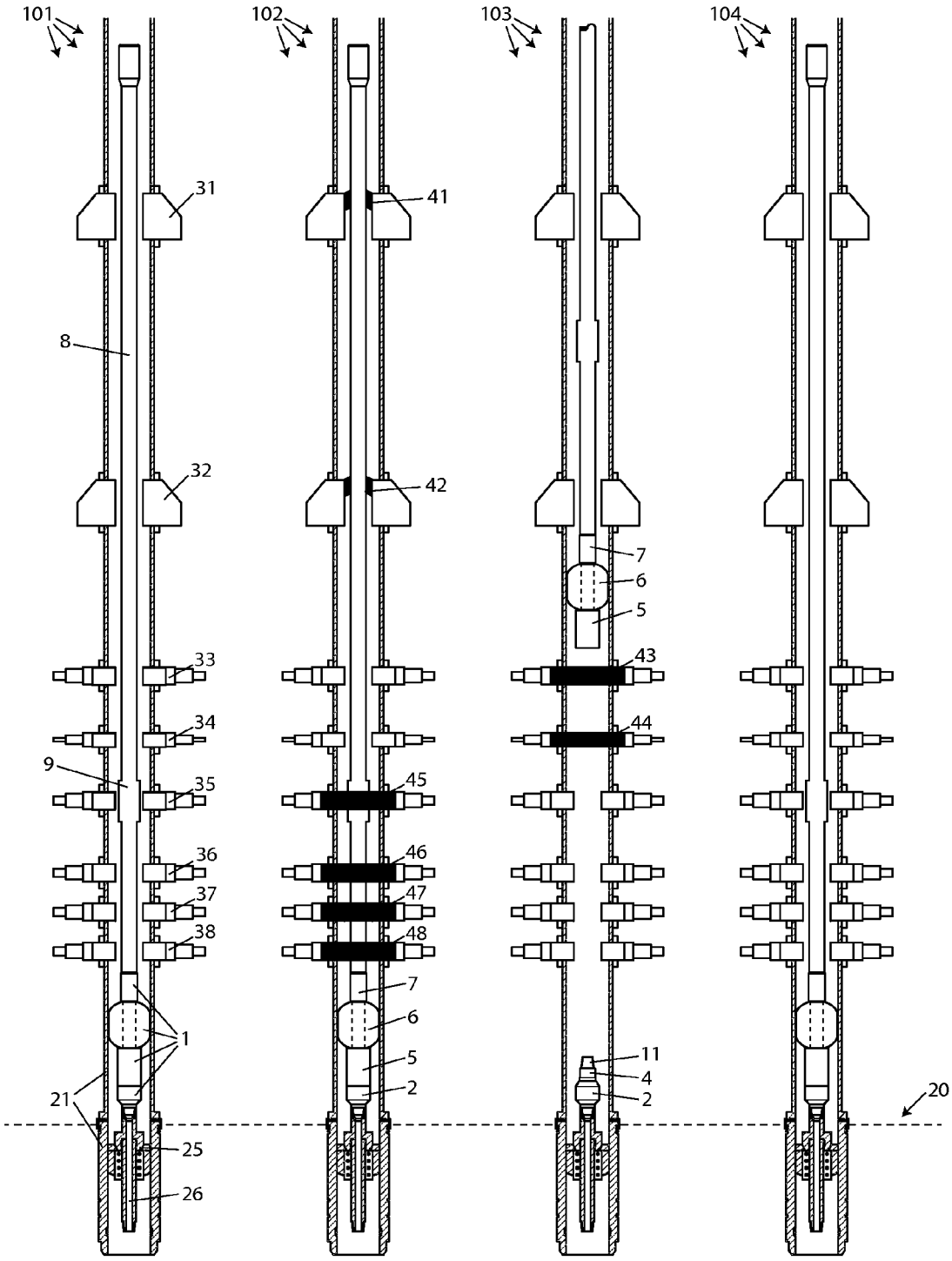
FIG. 3 is a schematic view of the invention in four stages of its use at the wellhead and blowout preventer stack.
Figure 4:
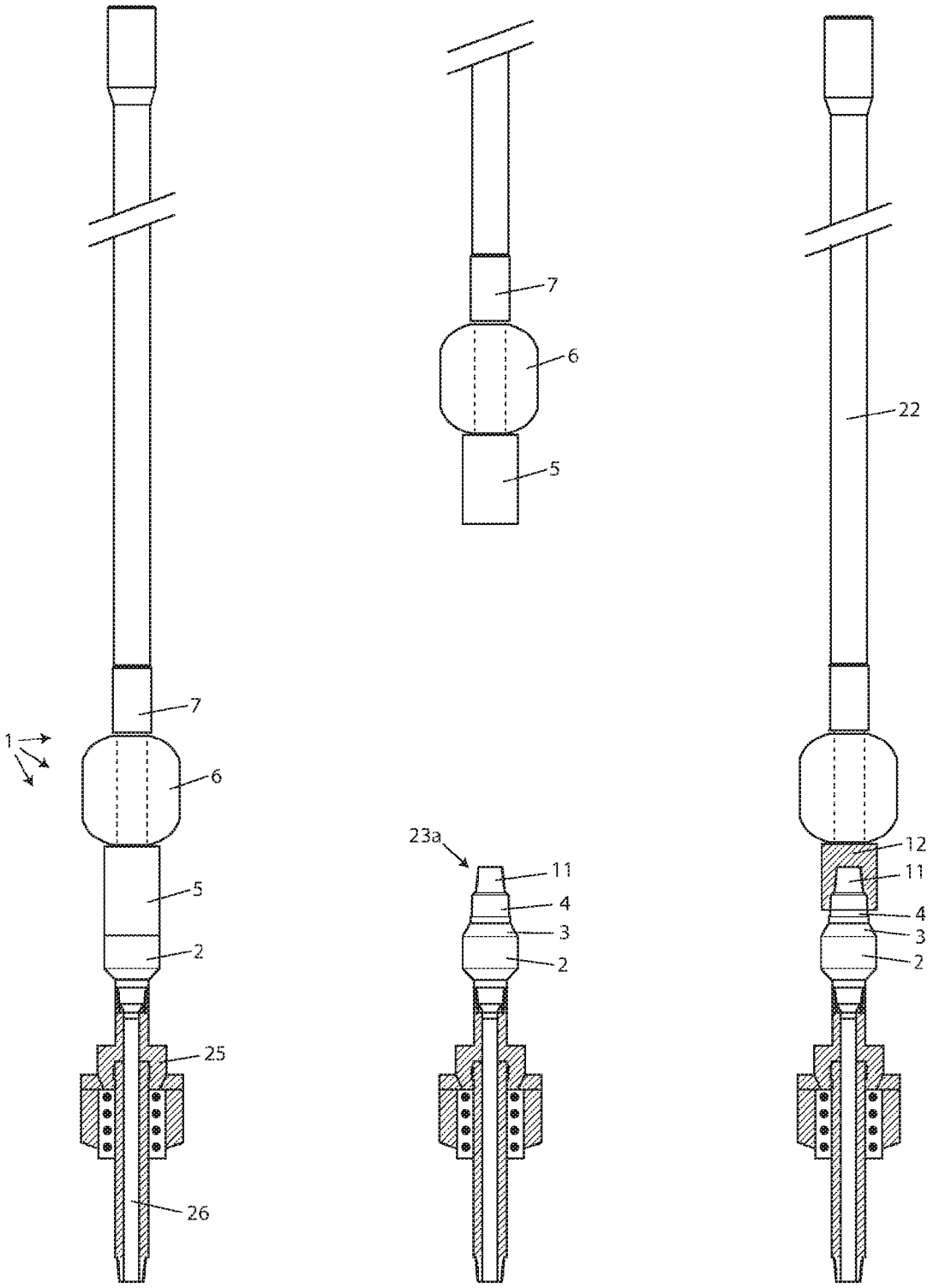
FIG. 4 is a schematic view of primary uncoupling and retrieval of the solid test pin, and the secondary, backup provision.

Referring to FIG. 3 and FIG. 4, in use, our blowout-preventer-stack one-trip test tool 1 is made up on a standard test plug and is lowered at the end of a drill string, through the casing 21 and the blowout preventer stack until the test plug is set in the wellhead at the mudline 20 or sea floor. The standard test plug 25 has an opening 26 that is securely plugged by the solid test pin 2, so that no leakage occurs between the BOP stack and the well below the test plug.

If the specific blowout preventer stack contains more than one fixed ram 35, 36, designed to accommodate different diameter sizes of drill pipe, then a special-purpose test joint 8 having various sized-pipe sections 9 corresponding to various BOP rams can be used, connected to the drill-pipe connector 7 at the top of the running tool 5, and connected at the other end to the drill string of drill pipe.

With the running tool 5 connected to the solid test pin 4 connected to the test plug 25, the test of the deployed BOP annulars 41, 42, fixed rams 45, 46, and variable rams 47, 48 are performed according to rig operating procedures. The annulars and fixed and variable rams seal around the drill pipe or test joint, which is in place for those tests.

Before testing the BOP blind and shear rams 33, 34, which would damage any drill pipe at those locations, the running tool 5 is disconnected from the solid test plug 2 by performing an appropriate number of left-hand turns on the drill string. Because the connection at the primary connector surface 4 is at a low torque relative to the very high torque of standard drill-pipe connections, the disconnection of the running tool from the solid test plug will occur more easily, and before, the loosening of any other connection. The drill string is then raised so that all drill pipe, test joint 8, and running tool 5 are safely above the level of the blind and shear rams. And then the tests of the deployed BOP blind and shear rams 43, 44 are performed according to rig operating procedures. The solid test pin 2 remains connected to the test plug 25, sealing the opening 26 in the test plug, during the BOP blind and shear ram test.

After completion of the BOP blind and shear ram testing, the drill string with the running tool 5 is slowly and carefully lowered onto the solid test pin 2 still connected to the test plug 25 at the wellhead, and is re-connected by performing an appropriate number of right-hand turns, applying the relatively low torque needed to make the connection. During this process of re-connection, the centralizer 6 keeps the running tool centered in the BOP stack, centered over the solid test pin 2 still connected to the test plug 25 at the wellhead. At the point of re-connection, the large entry bevel 3 on the running tool 5 guides the tool for a proper re-connection.

After re-connection of the running tool 5 and the solid test pin 2 connected to the test plug 25, the test plug is un-set from the wellhead and the entire test assembly is pulled out of the hole so that drilling operations can be resumed.

If the re-connection of the running tool 5 and the solid test pin 2 connected to the test plug 25 is not successfully performed, for whatever reason, the backup secondary retrieval procedure can be performed, in which the running tool is removed from the hole and from the drill string, and standard drill pipe 22 terminating in an emergency retrieval tool 12, is run into the hole to attach to the secondary connector surface 11, which also has standard drill-pipe threading 23 with first plug 23*a*, and is located in a position where the running tool 5 passes over it, but where the emergency retrieval tool 12 can attach to it. Then the test plug 25 can be un-set from the wellhead and retrieved, allowing drilling options to be resumed.

The relatively low torque required to make the connection of the running tool 5 to the solid test pin 2 is optimally not greater than 5000 foot-pounds, and the number of turns required to make or unmake the connection is optimally 7 turns.

Many changes and modifications can be made in the present invention without departing from the spirit thereof. We therefore pray that our rights to the present invention be limited only by the scope of the appended claims.

We claim:

1. A blowout-preventer-stack one-trip test tool, comprising:

a solid test pin having a primary connector surface at a medial location and a secondary connector surface at a top location;

a running tool adapted to removably couple, release, and re-couple, at a bottom location, with said solid test pin at said primary connector surface;

a centralizer mounted around a portion of said running tool, where said centralizer maintains said running tool in the center of the blowout preventer stack;

a drill-pipe connector at a top location of said running tool, having standard drill-pipe threads and adapted to operate with standard drill pipe;

where said solid test pin is adapted to securely removably attach at a bottom location to a standard test plug by standard drill-pipe threads;

where said running tool is adapted to attach to standard drill pipe at said drill-pipe connector, by standard drill-pipe threads, for lowering to the wellhead, testing, and retrieval;

where said secondary connector surface is adapted to attach to standard drill pipe by standard drill-pipe threads;

where said running tool is adapted to uncouple with said solid test pin, at the wellhead, in order to allow for partial withdrawal of the running tool and the drill string above for testing of blind and shear rams without damaging drill pipe, and to subsequently securely re-couple with said solid test pin for withdrawal of said test tool at completion of testing; and where said secondary connector surface having standard drill-pipe threads accommodates retrieval and withdrawal of said solid test pin attached to the standard test plug using an emergency retrieval tool.

2. The blowout-preventer-stack one-trip test tool of claim 1, further comprising a large entry bevel on said solid test pin and a corresponding bevel on said running tool.

3. The blowout-preventer-stack one-trip test tool of claim 1, further comprising a pin seal mounted between said primary connector surface and said running tool.

4. The blowout-preventer-stack one-trip test tool of claim 1, further comprising a pin-seal groove on said primary connector surface to accommodate a pin seal.

5. The blowout-preventer-stack one-trip test tool of claim 1, further comprising a test joint attached to said running tool at said drill-pipe connector.

6. The blowout-preventer-stack one-trip test tool of claim 1, further comprising a test joint having at least one sized-pipe section placed at a location corresponding to a fixed or specific sized blowout-preventer ram.

7. A method for testing, in one trip, all fixed, variable, blind and shear rams and annulars in a blowout preventer stack, without damage to pipe, comprising:

providing a blowout-preventer-stack one-trip test tool, comprising:

a solid test pin having a primary connector surface at a medial location and a secondary connector surface at a top location;

a running tool adapted to removably couple, release, and re-couple, at a bottom location, with said solid test pin at said primary connector surface;

a centralizer mounted around a portion of said running tool, where said centralizer maintains said running tool in the center of the blowout preventer stack;

a drill-pipe connector at a top location of said running tool, having standard drill-pipe threads and adapted to operate with standard drill pipe;

where said solid test pin is adapted to securely removably attach at a bottom location to a standard test plug by standard drill-pipe threads;

where said running tool is adapted to attach to standard drill pipe at said drill-pipe connector, by standard drill-pipe threads, for lowering to the wellhead, testing, and retrieval;

where said secondary connector surface is adapted to attach to standard drill pipe by standard drill-pipe threads;

where said running tool is adapted to uncouple with said solid test pin, at the wellhead, in order to allow for partial withdrawal of the running tool and the drill string above for testing of blind and shear rams without damaging drill pipe, and to subsequently securely re-couple with said solid test pin for withdrawal of said test tool at completion of testing; and where said secondary connector surface having standard drill-pipe threads accommodates retrieval and withdrawal of said solid test pin attached to the standard test plug using an emergency retrieval tool;

make up said solid test pin on a standard test plug;

make up drill pipe to said running tool at said drill-pipe connector;

make up said running tool to said primary connector surface of said solid test pin at relatively low torque;

lower the test assembly through the rotary and set the slips;

continue to make up drill pipe and run the assembly in hole;

set the test plug in the wellhead;

test the blowout preventer fixed and variable rams and annulars as per the rig test procedure;

rotate the drill string in a loosening direction to back off connection of said running tool to said solid test pin;

pick up drill string to raise the drill pipe and said running tools above level of any blind and shear rams to be tested;

test the blowout preventer blind and shear rams as per the rig test procedure;

lower the drill string and rotate in a tightening direction to make up said running tool to said primary connector surface of said solid test pin at relatively low torque;

pull out of hole with the complete test assembly.

8. The method for testing, in one trip, all fixed, variable, blind and shear rams and annulars in a blowout preventer stack, without damage to pipe, of claim 7, further comprising retrieving test assembly in the event of failure to re-couple said running tool to said solid test pin using an emergency retrieval tool coupled to said secondary connector surface having standard drill-pipe threads.

9. The method for testing, in one trip, all fixed, variable, blind and shear rams and annulars in a blowout preventer stack, without damage to pipe, of claim 7, further comprising inspecting said blowout-preventer-stack one-trip test tool for damage to threads.

10. The method for testing, in one trip, all fixed, variable, blind and shear rams and annulars in a blowout preventer stack, without damage to pipe, of claim 7, further comprising mounting a pin seal between said primary connector surface of said solid test pin and said running tool.

11. The method for testing, in one trip, all fixed, variable, blind and shear rams and annulars in a blowout preventer stack, without damage to pipe, of claim 7, further comprising running at least 25,000 pounds of weight of tail pipe below the test plug.

12. The method for testing, in one trip, all fixed, variable, blind and shear rams and annulars in a blowout preventer stack, without damage to pipe, of claim 7, where the relatively low torque to tighten the connection of said running tool to said solid test pin is not greater than 5000 foot pounds.

* * * * *